US006173825B1

(12) United States Patent
Liu

(10) Patent No.: US 6,173,825 B1
(45) Date of Patent: Jan. 16, 2001

(54) LIFT CONTROL DEVICE FOR A ROLLER SHADE

(76) Inventor: Tai-Ping Liu, No. 15, Alley 8, Lane 3, Kuo-Chi St., Lung-Ching Hsiang, Taichung Hsien (TW)

( * ) Notice: Under 35 U.S.C. 154(b), the term of this patent shall be extended for 0 days.

(21) Appl. No.: 09/378,784

(22) Filed: Aug. 23, 1999

(51) Int. Cl.[7] ..... E06B 9/56
(52) U.S. Cl. ..... 192/223.4; 160/298; 160/321
(58) Field of Search ..... 192/223.4, 41 S, 192/81 C; 160/298, 321; 188/82.6, 77 W; 267/155

(56) References Cited

U.S. PATENT DOCUMENTS 4,372,432 * 2/1983 Waine et al. ..... 192/223.4
5,375,643 * 12/1994 Rude ..... 160/321
5,507,374 * 4/1996 Rude ..... 192/223.4
5,669,432 * 9/1997 Nisenson et al. ..... 160/321 X
5,909,791 * 6/1999 DiStefano ..... 192/223.4
5,975,186 * 11/1999 Day ..... 160/321

* cited by examiner

*Primary Examiner*—Richard M. Lorence
(74) *Attorney, Agent, or Firm*—Thorp Reed & Armstrong, LLP

(57) ABSTRACT

A lift control device for a roller shade includes a support rod having one end containing an insert socket, a spring mounted on the support rod, a roller cap rotatably mounted on the support rod and containing a retaining opening to secure the spring therein such that the spring is rotated by the roller cap, and a follower spool secured on the roller cap to rotate therewith.

10 Claims, 5 Drawing Sheets

LIFT CONTROL DEVICE FOR A ROLLER SHADE

BACKGROUND OF THE INVENTION

1. Field of the Invention

The present invention relates to a lift control device, and more particularly to lift control device for a roller shade.

2. Description of the Related Art

The closest prior art of which the applicant is aware is disclosed in U.S. Pat. No. 4,433,765 to Rude et al., filed on Sep. 13, 1982, entitled "Spring Clutches". However, the springs are separately mounted on a limit rod, and the lugs for each of the springs has to align with each other so as to be fit into the slot of the cap, thereby making the assembly more difficult. In addition, the inner wall of the slot of the cap only contacts the lug of some of the springs, and cannot contact all of the springs such that the force exerted on the springs is not evenly distributed, thereby decreasing the retaining effect between the springs and the limit rod such that the force is concentrated on the springs which contact the cap causing elastic fatigue during long-term utilization, thereby greatly reducing the lifetime of the springs. The present invention has arisen to mitigate and/or obviate the disadvantage of the conventional spring clutch.

BRIEF SUMMARY OF THE INVENTION

In accordance with one aspect of the present invention, there is provided a lift control device for a roller shade comprising a support rod, one end containing an insert socket therein, a spring mounted on the support rod, a roller cap rotatably mounted on the support rod and containing a retaining opening to secure the spring therein such that the spring is rotated by the roller cap, and a follower spool secured on the roller cap to rotate therewith.

In accordance with another aspect of the present invention, there is provided a lift control device for a roller shade comprising a support rod, and a spring mounted on the support rod and including at least two coiled portions each having a bent distal end, and a connecting lug connecting the two coiled portions, the connecting lug being separated from the bent distal end of each of the two coiled portions.

Further benefits and advantages of the present invention will become apparent after a careful reading of the detailed description with appropriate reference to the accompanying drawings.

DETAILED DESCRIPTION OF THE INVENTION

Figure 1:
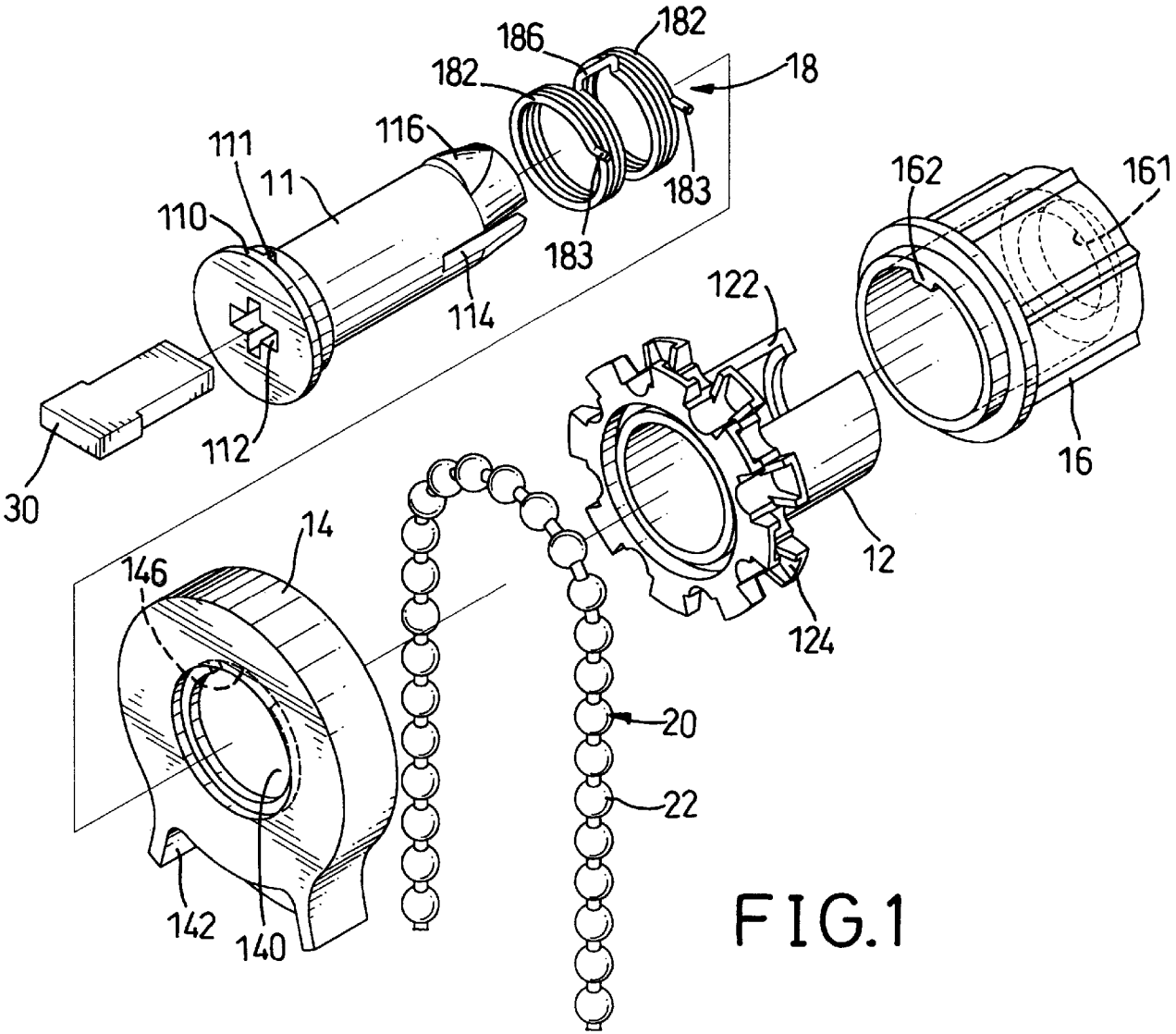
FIG. 1 is an exploded perspective view of a lift control device for a roller shade in accordance with the present invention.
Figure 2:
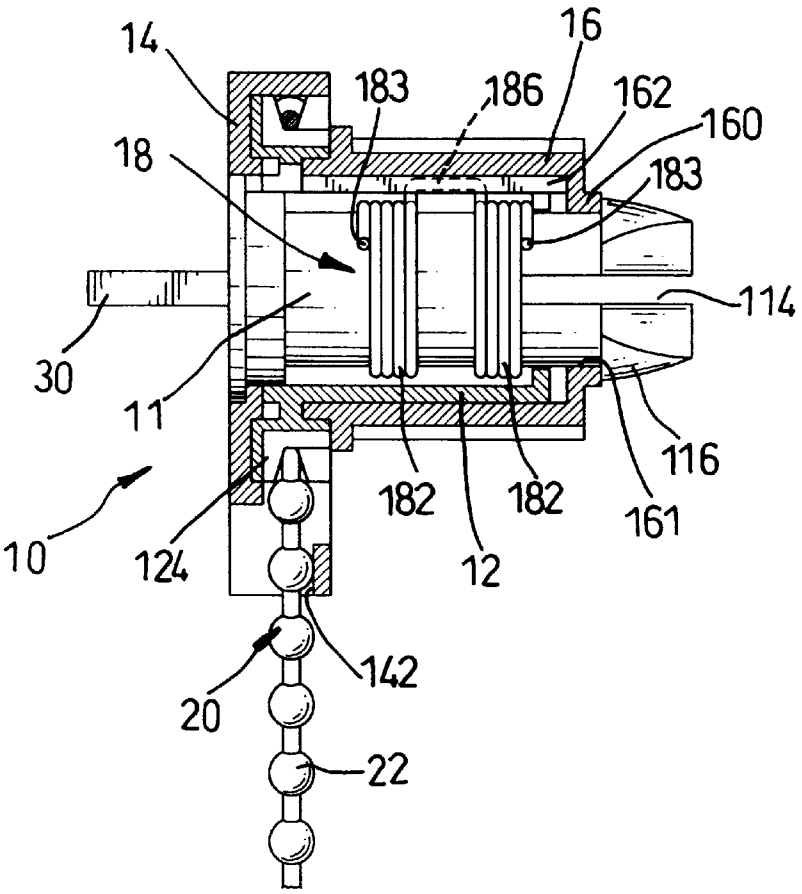
FIG. 2 is a front plan cross-sectional assembly view of the lift control device in FIG. 1.
Figure 3:
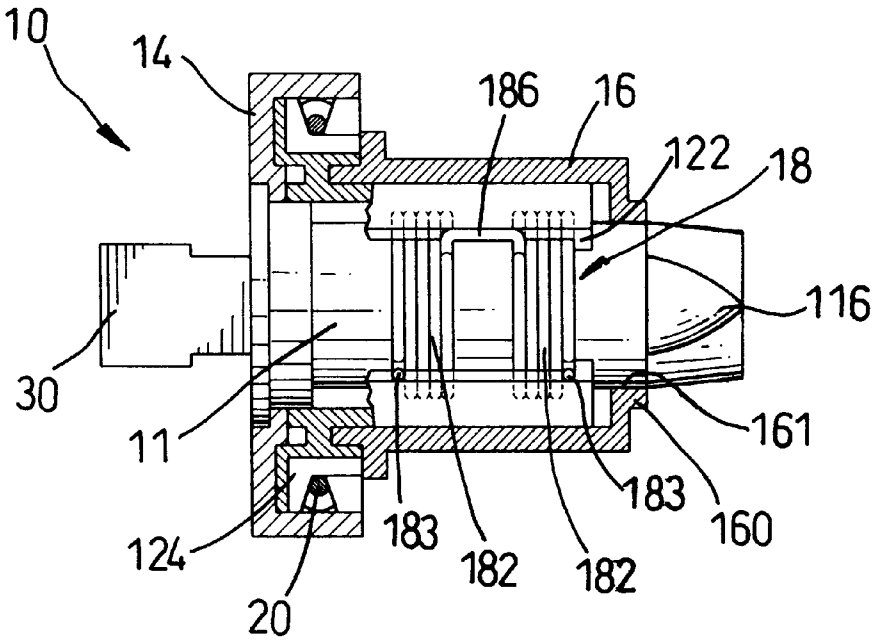
FIG. 3 is a top plan cross-sectional assembly view of the lift control device in FIG. 1.

Referring to the drawings and initially to FIGS. 1–3, a lift control device for a roller shade in accordance with the present invention comprises a support rod (11) with a cruciform shaped insert socket (112) in one end, an insert piece (30) detachably received in the insert socket (112), a spring (18) rotatably mounted on the support rod (11), a roller cap (12) rotatably mounted on the support rod (11) and containing a retaining opening (122) to secure the spring (18) therein such that the spring (18) is rotated by the roller cap (12), and a follower spool (16) mounted on the roller cap (12) and secured to the spring (18) to rotate with it.

The roller cap (12) includes a chain retaining wheel (124) mounted on one end thereof, and the lift control device comprises a loop-shaped chain (20) having a plurality of beads (22) secured to the chain retaining wheel (124) to rotate the chain retaining wheel (124), and a side cover (14) rotatably receiving the chain retaining wheel (124) of the roller cap (12) therein, and containing a chain outlet (142) to allow passage of the chain (20). The side cover (14) contains an axial hole (140) therein, and the support rod (11) extends through the axial hole (140) and includes an annular shoulder (110) formed on the end with the socket (112) and is pressed into the axial hole (140). The axial hole (140) of the side cover (14) contains an arcuate slot (146) defined in the periphery thereof, and the annular shoulder (110) includes a boss (111) movably received in the arcuate slot (146).

The follower spool (16) includes an annular flange (160) formed on one end and contains a retaining hole (161) therein, and the end of the support rod (11) away from the socket (112) extends through the retaining hole (161) and includes two hooks (116) abutting the annular flange (160). An elongated slot (114) is formed between the two hooks (116) such that the end of the support rod (11) is flexible.

The spring (18) includes two coiled portions (182) each having a bent distal end (183) abutting a one side of the retaining opening (122), and an inverted U-shaped connecting lug (186) connecting the two coiled portions (182) and abutting the other side of the retaining opening (122). The bent distal end (183) of the two coiled portions (182) aligns with each other. The connecting lug (186) is separated from the bent distal end (183) of each of the two coiled portions (182).

The follower spool (16) includes an elongated rib (162) formed on the inner wall thereof and movably located between the connecting lug (186) and the distal end (183) of each of the two coiled portions (182).

Figure 4:
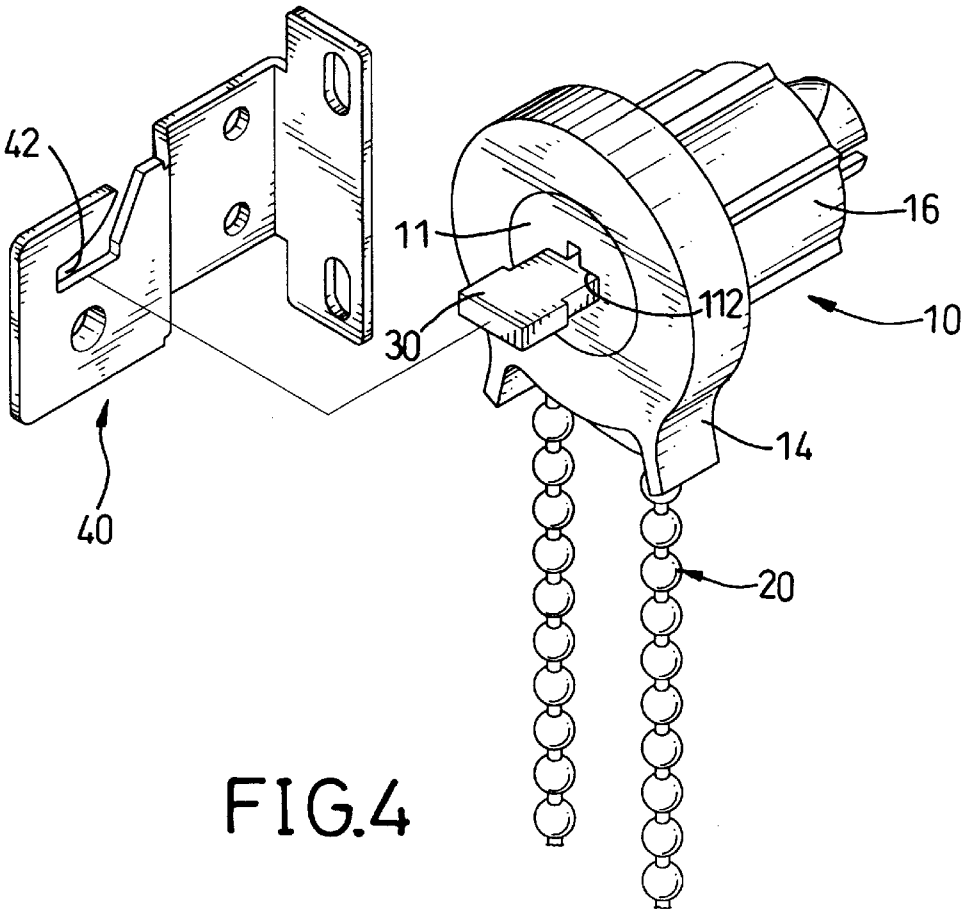
FIG. 4 is an exploded perspective view of the lift control device in FIG. 1 attached to a support bracket.

In assembly, referring to FIG. 4 with reference to FIGS. 1–3, two brackets (40) are attached to a vertical wall, and each contains a locking slot (42) therein, the insert piece (30) of the lift control device (10) is inserted into the locking slot (42) of a bracket (40), and a roller tube (not shown) having a shade cloth (not shown) mounted thereon includes one end securely fit on the follower spool (16) of the lift control device (10) to rotate therewith, and the other end rotatably attached to another bracket (40).

In operation, the support rod (11) is held in position by the insert piece (30) which is held in position in the retaining slot (42) of the bracket (40). The bent distal end (183) of each of the two coiled portions (182) of the spring (18) abuts the first side of the retaining opening (122), and the connecting lug (186) abuts the second side of the retaining opening (122) such that the spring (18) is rotated with the roller cap (12). The elongated rib (162) is located between the distal end (183) of each of the two coiled portions (182) and the connecting lug (186) such that the follower spool (16) is rotated with the spring (18) by the distal end (183) or the connecting lug (186).

When the a user exerts a drawing force on the loop-shaped chain (20), the chain retaining wheel (124) is rotated by the chain (20) to rotate the roller cap (12) which rotates the spring (18) which rotates the follower spool (16) which rotates the roller tube, thereby lifting or lowering the shade cloth. When the drawing force exerted on the chain (20) is removed, further movement of the follower spool (16) is limited by the spring (18) due to the friction between the coiled portions (182) and the support rod (11) such that the follower spool (16) will not be reversed by the weight of the shade cloth.

Figure 5:
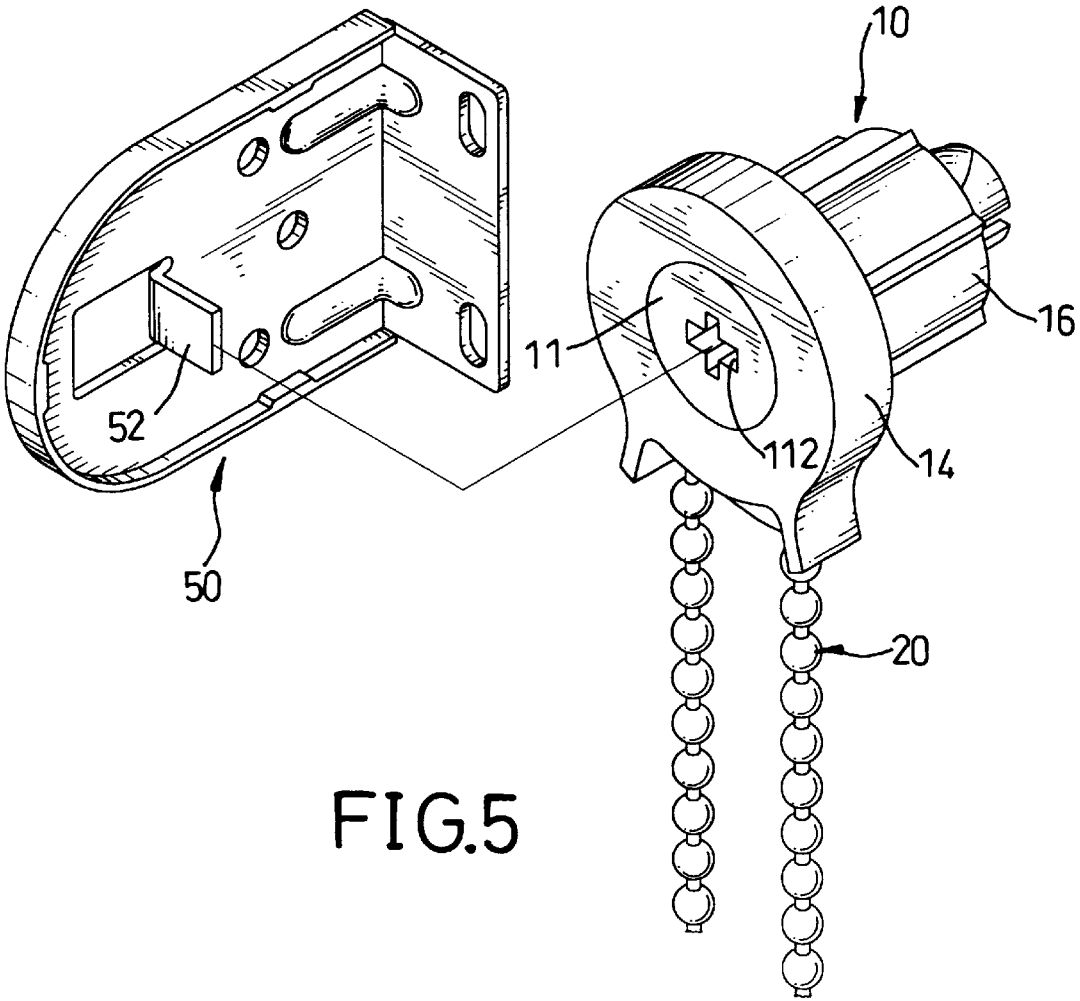
FIG. 5 is an exploded perspective view of another embodiment of the lift control device in accordance with the present invention attached to a support bracket.

Referring to FIG. 5 with reference to FIGS. 1–3, in accordance with another embodiment of the present invention, two brackets (50) are attached to a vertical wall, and each includes an insert piece (52). The insert piece (52) of a bracket (50) is inserted into the insert socket (112) of the support rod (11) of the lift control device (10), and a roller tube (not shown) having a shade cloth (not shown) mounted thereon includes one end securely fit on the follower spool (16) of the lift control device (10) to rotate therewith, and the other end rotatably attached to the other bracket (50).

The springs bodies (182) are integrally formed with each other, thereby increasing the precision of alignment. In addition, the force is evenly distributed on the coiled portions (182) of the spring (18) which mate with the support rod (11) to provide an even retaining effect to the follower spool (16), thereby preventing elastic fatigue due to the coiled portions (182) being unevenly stressed so as to increase the lifetime of the spring (18). Further, the insert piece (30) received in the insert socket (112) is inserted into the locking slot (42) of the bracket (40) as shown in FIG. 4, or the insert socket (112) is used to receive the insert piece (52) of the support bracket (50) as shown in FIG. 5, thereby increasing the versatility of the lift control device (10) and decreasing the cost in fabrication.

It should be clear to those skilled in the art that further embodiments may be made without departing from the scope of the present invention.

What is claimed is:

1. A lift control device for a roller shade comprising:

a support rod (11) with one end containing an insert socket (112);

a spring (18) mounted on said support rod (11);

a roller cap (12) rotatably mounted on said support rod (11) and containing a retaining opening (122) to secure said spring (18) in the retaining opening (122) and a chain retaining wheel (124) mounted on one end of the supporting rod (11);

a follower spool (16) secured on said roller cap (12) to rotate with the cap (12);

a chain (20) secured to said chain retaining wheel (124) to rotate said chain retaining wheel (124); and a side cover (14) rotatably receiving said chain retaining wheel (124) of said roller cap (12) in said side cover (14), and containing a chain outlet (142) to allow passage of said chain (20) and an axial hole (140) in said side cover (14);

wherein said axial hole (140) in said side cover (14) contains an arcuate slot (146) defined in the periphery of said axial hole (140), and said annular shoulder (110) includes a boss (111) movably received in said arcuate slot (146);

said support rod (11) extends through said axial hole (140) and includes an annular shoulder (110) formed on the end with the socket (112) and secured in said axial hole (140).

2. The lift control device in accordance with claim 1, wherein said insert socket (112) has a cruciform shape to accept different sized insert pieces (30).

3. The lift control device in accordance with claim 1, further comprising an insert piece (30) detachably received in said insert socket (112).

4. The lift control device in accordance with claim 1, wherein the end away from the socket (112) of said support rod (11) contains an elongated slot (114).

5. The lift control device in accordance with claim 1, wherein said follower spool (16) includes an annular flange (160) formed on one end thereof and contains a retaining hole (161) therein, and the end of said support rod (11) away from the socket (112) extends through said retaining hole (161) and includes two hooks (116) abutting said annular flange (160).

6. The lift control device in accordance with claim 1, wherein said follower spool (16) includes an elongated rib (162) formed on the inner wall thereof and movably located in said retaining opening (122) of said roller cap (12).

7. The lift control device in accordance with claim 1, wherein said spring (18) includes at least two coiled portions (182) each having a bent distal end (183) abutting one side of said retaining opening (122), and a connecting lug (186) connecting said two coiled portions (182) and abutting the other side of said retaining opening (122).

8. The lift control device in accordance with claim 7, wherein said connecting lug (186) is an inverted U-shape.

9. The lift control device in accordance with claim 7, wherein said bent distal ends (183) of said two coiled portions (182) align with each other.

10. The lift control device in accordance with claim 7, wherein said follower spool (16) includes an elongated rib (162) formed on the inner wall thereof and movably located between said connecting lug (186) and said distal end (183) of each of said two coiled portions (182).

* * * * *